US005611300A

United States Patent [19]

Gray, Jr.

[11] Patent Number: 5,611,300

[45] Date of Patent: Mar. 18, 1997

[54] FLOATING PISTON, PISTON-VALVE ENGINE

[75] Inventor: Charles L. Gray, Jr., Pinckney, Mich.

[73] Assignee: The United States of America as represented by the Administrator of the Environmental Protection Agency, Washington, D.C.

[21] Appl. No.: 540,771

[22] Filed: Oct. 11, 1995

[51] Int. Cl.[6] ..... F02B 75/04; F02B 75/36

[52] U.S. Cl. ..... 123/48 A; 123/51 A; 123/78 A

[58] Field of Search ..... 123/188.4, 48 A, 123/48 AA, 48 R, 51 A, 78 A

[56] References Cited

U.S. PATENT DOCUMENTS

| | | | |
|---|---|---|---|
| 752,273 | 2/1904 | Vogt | 123/48 A |
| 1,259,988 | 3/1918 | Huff | 123/78 A |
| 1,464,164 | 8/1923 | Alarie | 123/78 A |
| 1,564,009 | 12/1925 | Myers | 123/78 A |
| 2,592,829 | 4/1952 | Skinner | 123/48 AA |
| 2,769,433 | 11/1956 | Humphreys | 123/48 AA |
| 4,286,552 | 9/1981 | Tsutumi | 123/48 AA |

*Primary Examiner*—Erick R. Solis
*Attorney, Agent, or Firm*—Lorusso & Loud

[57] ABSTRACT

The present invention is an improved drive train which includes an engine having at least one power cylinder with a power piston mounted for reciprocating motion therein. The power piston is connected to a crank shaft in the usual manner for translation of the reciprocating motion of the power piston into rotation of the crankshaft, which in turn, is transmitted in the conventional manner to the drive wheels of the vehicle. Provision is made for the feed of fuel into a combustion chamber located within the power cylinder at one side of the power piston. Intake and exhaust valves, in fluid communication with the combustion chamber serve, respectively, to allow intake of air during an intake stroke of the power piston and exhaust of combustion products during an exhaust stroke of the power piston. A floating piston at least partially closes the combustion chamber opposite the power piston and is mounted for reciprocating motion relative to the combustion chamber. The reciprocating motion of the floating piston includes a pressure relieving stroke in which the floating piston moves away from the combustion chamber responsive to a predetermined pressure being produced within the combustion chamber by combustion, to reduce the peak combustion pressure.

12 Claims, 6 Drawing Sheets

FIG. 2a
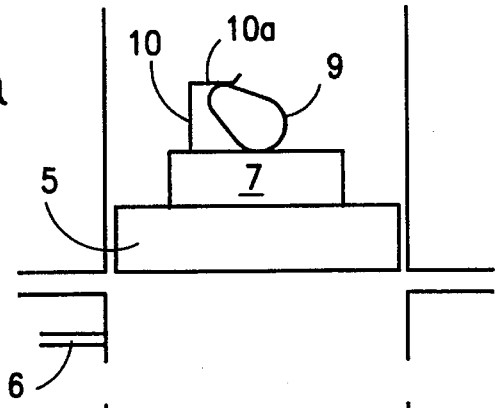
FIG. 1
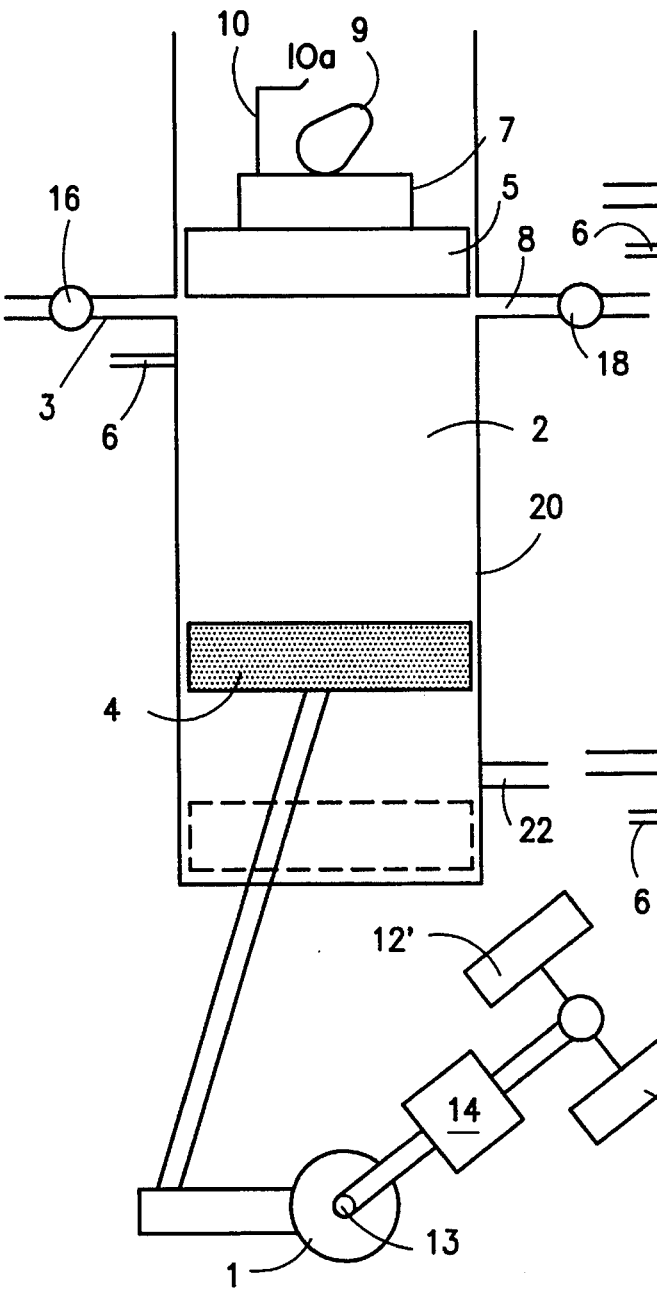
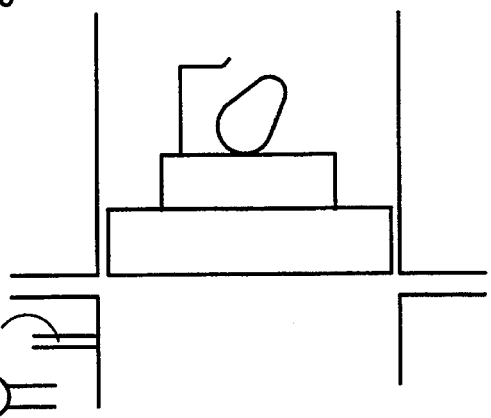
FIG. 2b
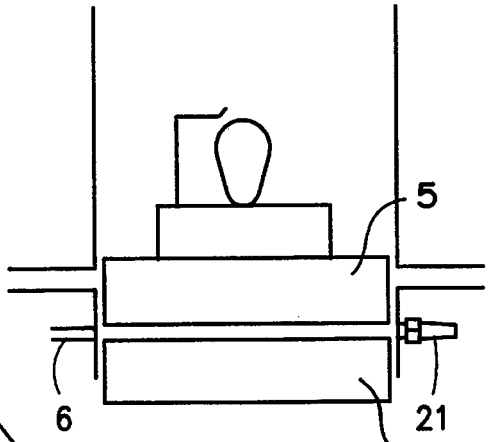
FIG. 2c

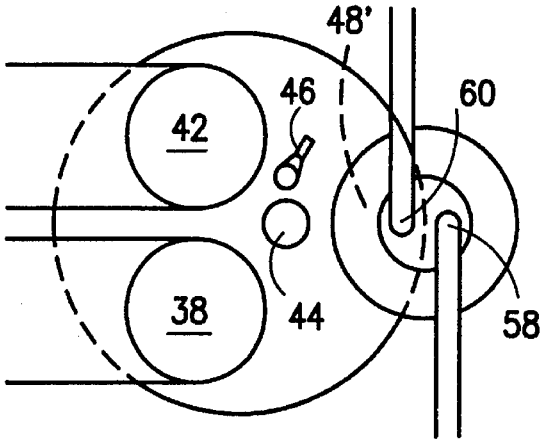
FIG. 7
FIG. 6
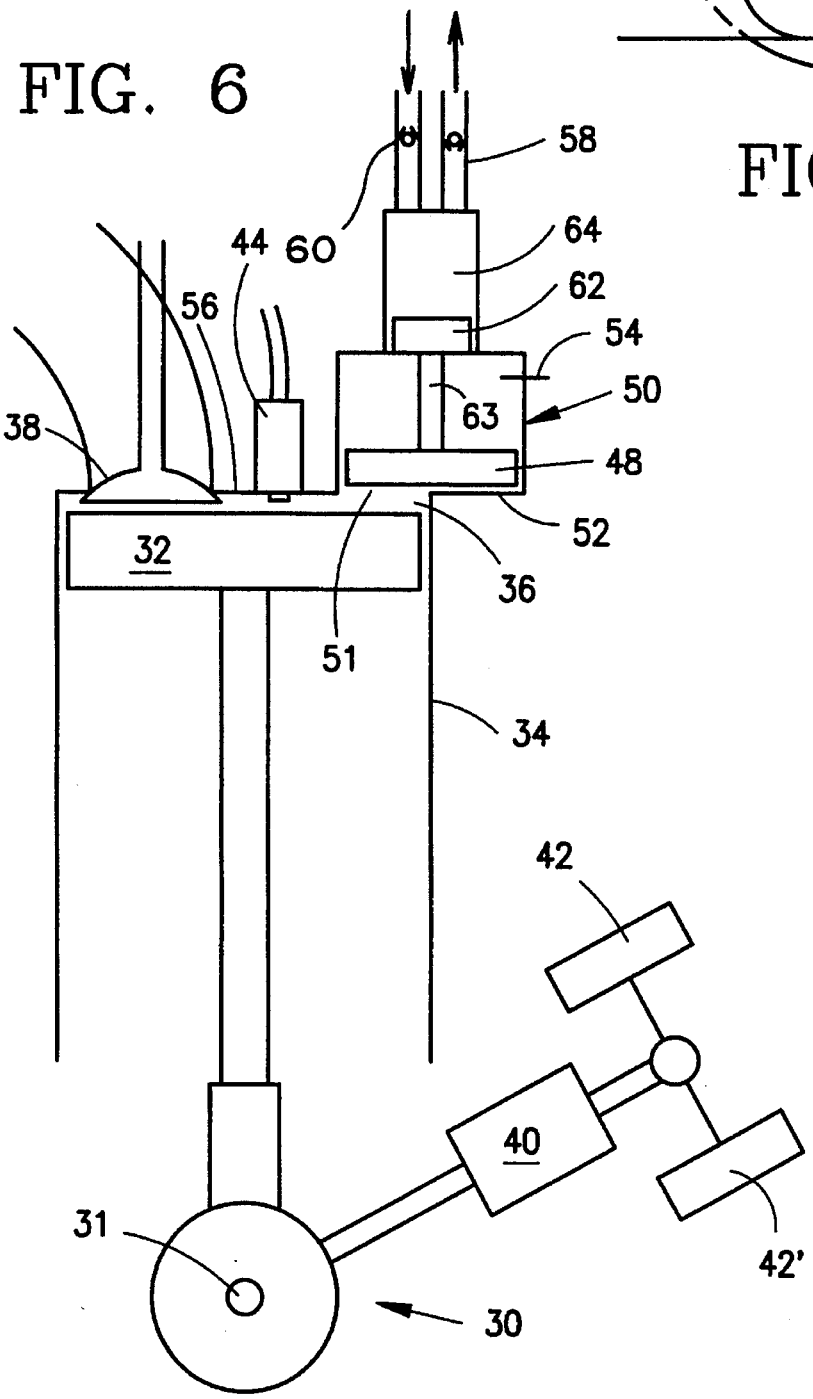
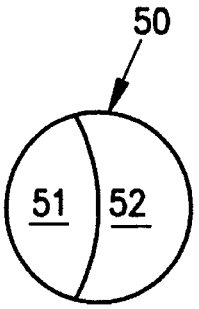
FIG. 8

FLOATING PISTON, PISTON-VALVE ENGINE

BACKGROUND OF THE INVENTION

1. Field of the Invention

The invention is a new internal combustion engine that reduces the formation of NOx and increases fuel energy utilization efficiency. The primary field of application is motor vehicle engines.

2. The Prior Art

The growing utilization of automobiles greatly adds to the atmospheric presence of various pollutants including oxides of nitrogen and greenhouse gases such as carbon dioxide. Internal combustion engines used in passenger vehicles average about 15% thermal efficiency in urban driving and have peak efficiencies of about 35%. Even when considering peak efficiency, current engine designs discard almost two thirds of the heat energy supplied to them through the engine coolant system or through the exhaust gas.

The chemical energy contained in fuel is converted into heat energy when it is burned in an engine. Since this combustion takes place in a closed volume (the combustion chamber of the engine), the increased temperature of the combustion gases (and in some cases the increased number of moles of the combustion gases as compared to the reactants) results in an increase in pressure of the system. As the volume of the combustion chamber expands, e.g., the piston moves, work is performed. The increased temperature resulting from combustion, which occurs before the piston begins its rapid expansion, results in the oxidation of some atmospheric nitrogen to form NOx.

Characteristics of conventional engines result in much of the available heat energy being wasted via three routes. First, the combustion chamber is cooled by liquid or air, thus reducing pressure and the potential for work. Second, the expansion process does not fully expand to fully utilize the pressure of the combustion chamber, as the expansion ratio is usually limited by the compression ratio. Third, much heat remains in the exhaust gas.

SUMMARY OF THE INVENTION

An object of the present invention is to significantly improve the efficiency of fuel utilization for automotive powertrains while still achieving low levels of NOx emissions.

The several shortcomings of conventional internal combustion engines that are addressed by the subject invention are: (1) the high temperatures of combustion form oxides of nitrogen and promote the loss of heat energy to the combustion chamber walls and engine coolant (thus reducing fuel efficiency); (2) the high pressures associated with peak combustion temperatures produce large peak forces on the combustion chamber walls which set the structural design requirements, and this directly affects engine costs; such forces also act on the piston(s) (one of the combustion chamber walls) dictating the various bearings' structural design requirements and thus directly affecting bearing size (increasing cost and frictional losses); (3) the poppet valves which are used for controlling the intake of air and discharge of exhaust gases, are costly, produce restrictions to the flow of gases (and thus reduce engine efficiency), open inwardly to the combustion chamber and thus are hard to cool making reduced heat-loss engine designs more difficult (usually the constraining component); and (4) the fixed geometry of conventional piston engines makes achieving a higher expansion ratio than compression ratio (for improved efficiency) difficult.

Accordingly, the present invention provides an improved drive train for powering the drive wheels of a vehicle, designed to overcome the above-noted shortcomings. The improved drive train of the present invention includes an engine which has at least one power cylinder with a power piston mounted for reciprocating motion therein. The power piston is connected to a crankshaft in the usual manner for translation of the reciprocating motion of the power piston into rotation of the crankshaft, which in turn, is transmitted in the conventional manner to the drive wheels of the vehicle. Provision is made for the feed of fuel into a combustion chamber located within the power cylinder, at one side of the power piston for certain embodiments. Intake and exhaust valves, in fluid communication with the combustion chamber, serve, respectively, to allow intake of air during an intake stroke of the power piston and exhaust of combustion products during an exhaust stroke of the power piston. A floating piston at least partially closes the combustion chamber opposite the power piston and is mounted for reciprocating motion relative to the combustion chamber. The reciprocating motion of the floating piston includes a pressure relieving stroke in which the floating piston moves away from the combustion chamber, responsive to a predetermined pressure being produced within the combustion chamber by combustion, to reduce the peak combustion pressure and temperature.

Optionally, a camming mechanism is included for controlling, at least during a portion of the operating cycle, the position of the floating piston. In such embodiments, a spring device is interposed between the camming mechanism and the floating piston to absorb the peak combustion pressure and a retainer is fixed to the floating piston, optionally through the spring device, for engagement by the camming mechanism. In these embodiments the floating piston serves as a valving mechanism to alternately cover and uncover the combustion chamber intake and exhaust ports.

In another embodiment, the invention includes an auxiliary cylinder housing the floating piston and in fluid communication with the combustion chamber. In this latter embodiment, the floating piston is rigidly fixed to a pump piston which reciprocates within a pump housing to deliver a fluid pressure which may be used, for example, to provide a power assist.

The terminology "spring steel" and "spring means", as used herein are generalizations for means of "instantaneously" reacting/responding to the rapid pressure rise associated with combustion, as compared to the slower, fixed path movement of the piston.

Parenthetically, combustion usually begins even before the piston reaches its top dead center, TDC, position on the compression stroke, and maximum pressure occurs just after TDC, but before the piston begins its rapid movement downward in the expansion or power stroke. The slowest rate of change of combustion chamber or system volume occurs near piston TDC, and bottom dead center, BDC. The fastest rate of change of system volume occurs at 90° after TDC, and 90° before TDC. Thus, the pressure rise will occur before, and must be contained until, the piston and crank mechanism are "ready" to begin the expansion process.

The "spring steel" begins to absorb energy of expansion "immediately," once the combustion pressure rises above some set value higher than the compression pressure. This absorbed energy is either used directly or released as the piston begins its rapid expansion and is recovered as increased shaft work through the conventional expansion process.

By "immediately" expanding the combustion gases as the combustion process occurs (as the "spring steel" allows), the peak system temperature and pressure are limited. FIG. 3 shows the cylinder pressure in a typical engine as a function of cylinder volume (i.e., piston movement). The "typical engine" illustrated by the graph of FIG. 3 has a stroke of 86.4 mm and a bore of 79.5 mm. The top line A represents the power stroke and bottom line B represents the compression stroke for the typical engine, whereas line C illustrates how the graph is modified by the same sized engine designed in accordance with the embodiment of FIG. 1. The heavy line D is indicated at 60 bar pressure to show an example set-point for the "spring steel" to begin absorbing energy, i.e. just after initiation of combustion. The cylinder gas temperature follows pressure and is constrained as well. This feature of the invention: (1) limits peak pressure which reduces mechanical stresses and therefore reduces engine cost and friction; and (2) limits peak temperature which reduces the formation of NOx and the loss of heat energy to the engine coolant.

The "floating top" of the embodiment of FIGS. 1 and 2*a*, 2*b* and 2*c* serves two functions. First, as a ring-sealed sliding piston mechanism, it serves as a valve mechanism for controlling the flow of intake and exhaust gases. This feature of the invention replaces the popper valves of conventional engines and addresses the shortcomings previously described.

The second feature of the "floating top" in the embodiment of FIG. 1 is that it can be released at a set-point position during the intake stroke, e.g., at 90° after TDC. The "floating top" 5 then shuts off the introduction of more air through intake 3 and travels with the power piston 4 as it completes its downward stroke. The timing of the release of the "floating top" 5 controls the amount of air admitted through intake 3. As the piston 4 begins its upward compression stroke, the downward motion of the "floating top" 5 is stopped by the increasing pressure of the compressed intake air and then it then begins upward motion until it reaches its upper, compression-stroke position (FIG. 2*c*). The power piston 4 then completes its compression stroke. By allowing a less than complete air charge, the compression ratio of the engine can be any fraction of the expansion ratio. For example, if the expansion ratio is 30 to 1 and the "floating top" was released such that only one half the normal air charge was introduced, then the compression ratio would be 15 to 1. The present invention preferably provides an expansion ratio which is at least 1.2 and, most preferably, 1.2–1.5 times the compression ratio. FIG. 4 shows that significant efficiency gains are achieved when the expansion (exp.) ratio exceeds the compression ratio. In FIG. 4 lower line E represents the conventional compression ratio, which conventionally equals the expansion ratio, whereas upper line F represents expansion ratios with full expansion.

In the embodiment of FIG. 5 the above-mentioned second feature is lacking because the floating top 5 never releases.

However, the embodiment of FIG. 5 retains the function of the steel spring in absorbing and releasing peak combustion pressure and retains the valving function of the floating top.

In the embodiment of FIGS. 6–8 the floating piston 48 functions in a manner analogous to floating top 5 and spring steel 7 in the other embodiments to "absorb" peak combustion pressure. The embodiment of FIGS. 6–8 also possesses the feature of an expansion ratio exceeding the compression ratio but lacks the valving feature.

BRIEF DESCRIPTION OF THE DRAWINGS

FIG. 1 is a schematic illustration of a first embodiment of the present invention;

FIG. 2*a* is a schematic illustration of the positions of key components of the first embodiment during a first portion of the intake stroke and during the exhaust stroke;

FIG. 2*b* is a schematic illustration of the positions of key components of the first embodiment at the initiation of the second portion of the intake stroke;

FIG. 2*c* is a schematic illustration of the positions of key components of the first embodiment during final stages of the compression stroke, during combustion and for the initial stage of the power stroke;

FIG. 6 is a schematic illustration showing a third embodiment of the present invention in side view;

FIG. 7 is a schematic illustration showing the third embodiment of the present invention in top view;

FIG. 8 is a bottom view of cylinder 50 of the third embodiment; and

DESCRIPTION OF THE PREFERRED EMBODIMENTS

Figure 3:
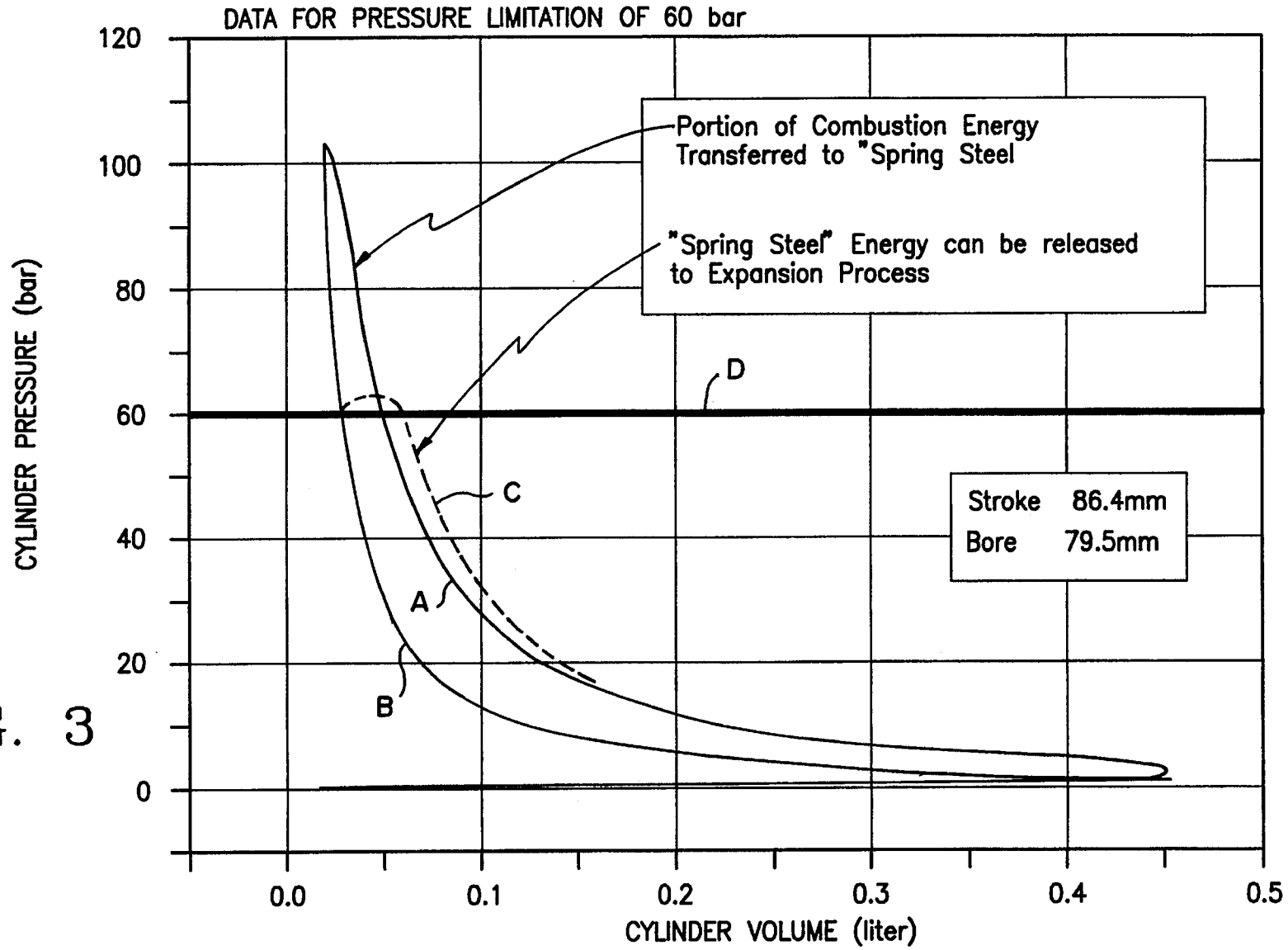
FIG. 3 is a graph of cylinder pressure versus cylinder volume illustrating operation over a complete cycle of operation of a conventional engine and an engine of the first embodiment.
Figure 4:
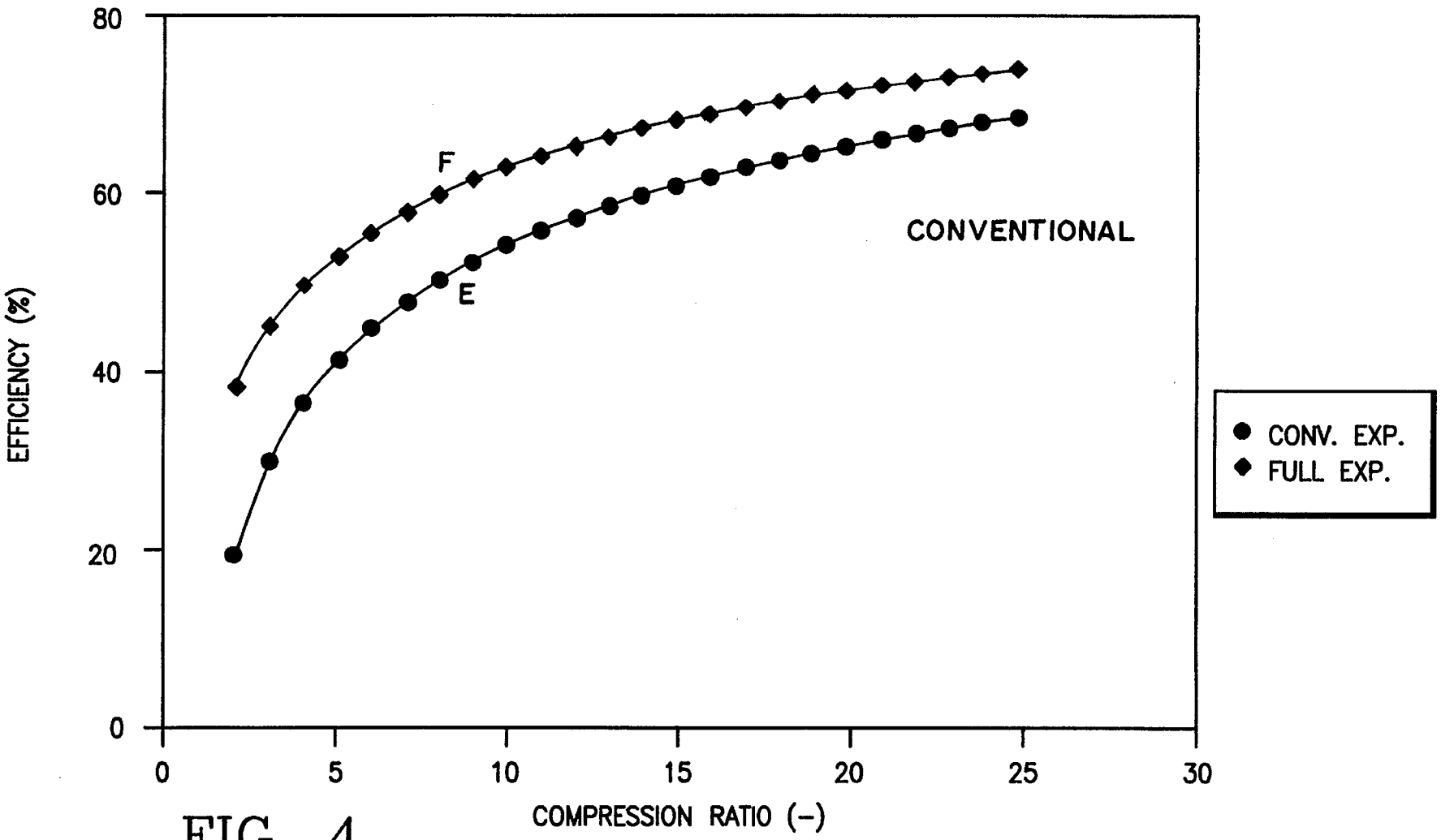
FIG. 4 is a graph of engine efficiency versus compression and expansion ratios.

The embodiment shown in FIGS. 1, 2*a*, 2*b* and 2*c* utilizes a four stroke cycle and the conventional reciprocating piston engine motion and drive mechanism 1 to drive a pair of wheels 12, 12' through a transmission 14. During the first part of the intake stroke, air ("air" as used herein should be understood to mean either atmospheric air or a mixture of atmospheric air and recirculated exhaust gas) is introduced to the combustion chamber 2 through intake port 3 as the power piston 4 travels from its top stroke position to some point before its bottom stroke position. During the first part of the intake stroke (and initially during the exhaust stroke) the floating top 5 is held in its uppermost position by cam 9 and retainer 10 as shown in FIG. 2*a*. Simple, one-way valves 16 and 18 are contained in the intake and exhaust ports, respectively, away from the hot combustion process, to insure proper flow of gases. Positioning the intake and exhaust ports at different levels would allow the deletion of one port valve, but would require the increased complexity of an additional top-position of the "floating top" positioning mechanism. Accordingly, the preferred embodiment is as shown in FIG. 1 wherein the intake and exhaust ports are bisected by a single plane perpendicular to the axis of the cylinder 20. The beginning of the second part of the intake stroke is marked by the release of the "floating top" piston 5 from retainer 10 as shown in FIG. 2*b*. The "floating top" 5 travels with piston 4, as it completes its downward stroke, reverses direction with piston 4 as it begins the compression stroke, and travels with piston 4 during the first portion of the compression stroke to the position shown in FIG. 2*c*. Power piston 4 then completes the compression stroke, as previously described. Fuel is injected through fuel injector 6 and ignited by the compression temperature or by a spark plug 21 (or glow plug or other means). The increased pressure of the system first compresses spring 7, constraining system pressure and temperature. As the piston 4 begins its downward stroke, the pressurized gases transfer the energy stored in the compressed spring 7 to the piston 4 as spring 7 de-compresses, and finally the pressurized gases complete their expansion as the piston 4 reaches its bottom stroke position. As the piston 4 travels to its next top stroke position, the "floating top" 5 moves to the position shown in FIG. 2*a*. The exhaust stroke position of floating top 5, the same position that it retains for the first part of the next intake stroke, allows exhaust gases to be expelled through exhaust port 8.

As noted above, preferably both the intake port and the exhaust port are coplanar, i.e. bisected by a single plane, perpendicular to the central axis of the cylinder 20. The fuel injector 6 is shown in FIG. 2*c* as axially spaced from the intake and exhaust ports 3 and 8 but could be located in the intake 3.

The cylinder 20 is vented below piston 4 through vent 22 to atmospheric pressure in the crankcase (not shown).

The "floating top" position actuator is shown as a cam 9 but, in the alternative, can be a rotating crank or other mechanical mechanism, a hydraulically driven mechanism, or other similar means of controlling the position of the "floating top". In the embodiment illustrated in FIGS. 1 and 2 *a*–2*c* the cam 9 is on a camshaft driven off of the crankshaft 13 through a timing belt or gear mechanism. Fixed to the floating top (through spring 7 in the embodiment of FIG. 1) is a retainer 10 having a bent (at 90°) distal arm portion 10*a* which is engaged by the cam 9 to hold the floating top 5 during an initial portion of the intake and during the exhaust stroke. The spring means may be any of various means for achieving quick energy storage and quick release including coil springs, bellows springs, a "free piston" to compress a closed volume of gas (to be described in an embodiment of a hydraulic pump in more detail in connection with FIGS. 6–8), and other rapidly compressible/expandable mechanisms.

Figure 5:
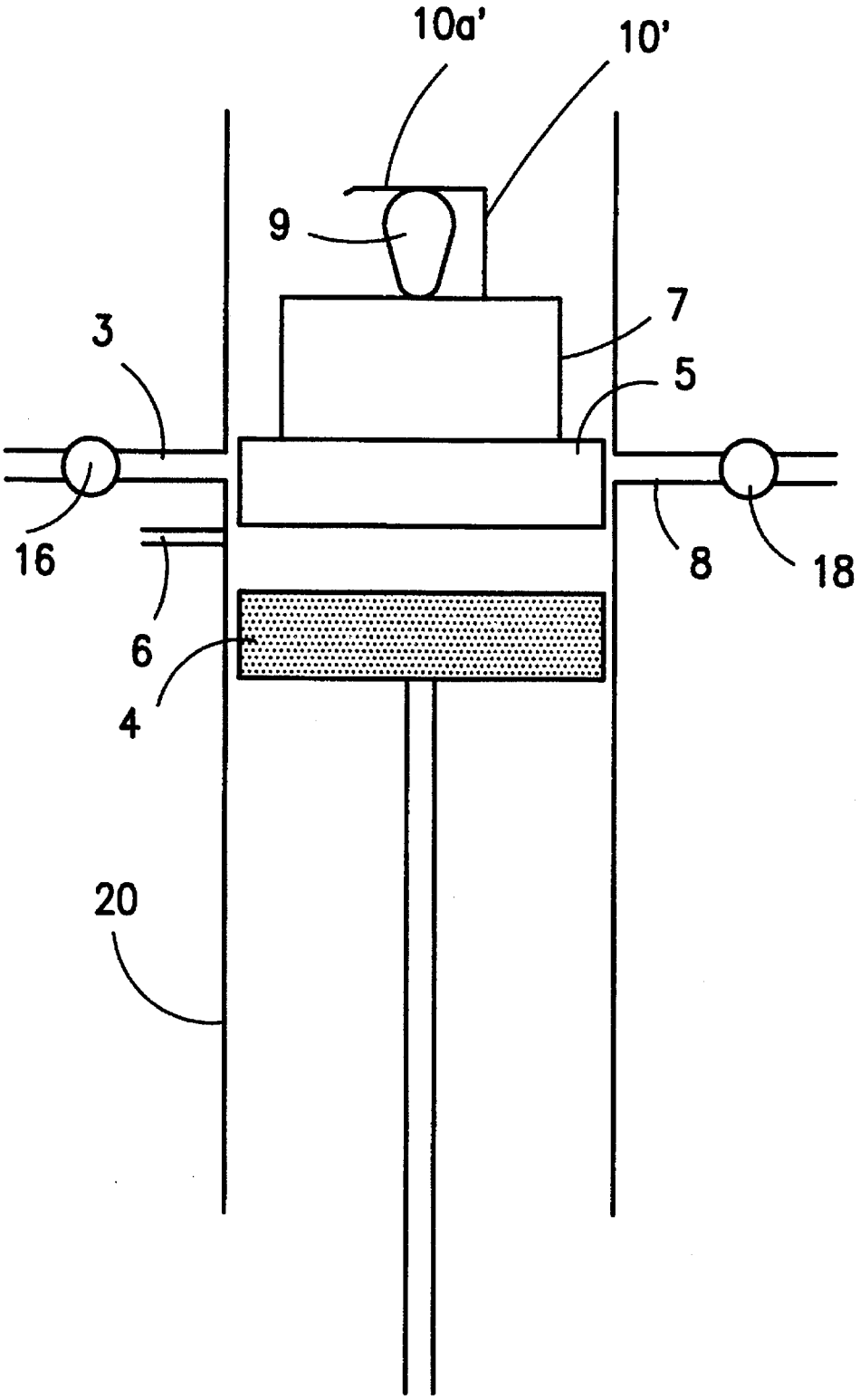
FIG. 5 is a schematic illustration of a second embodiment of the present invention.

FIG. 5 shows an embodiment which differs from the embodiment of FIGS. 1, 2*a*, 2*b* and 2*c* in that the "floating top" is constrained throughout the entire cycle of strokes. In this embodiment the retainer 10' has a right-angle distal arm portion 10*a*' longer than 10*a* of the previously described embodiment so that contact between 10*a*' and cam 9 is maintained throughout the four stroke cycle.

FIGS. 6, 7 and 8 illustrate an embodiment of the present invention wherein a floating top 48 is linked to a "free" or "floating" piston 62 of a hydraulic pump. A pump chamber 64 receives liquid through inlet 60 and the pumping action of piston 62 supplies fluid pressure through outlet 58 to drive a hydraulic motor or for storage in an accumulator. Piston 62 is rigidly fixed to piston 48 through piston rod 63. Piston 48 reciprocates in a cylinder 50 which vents through vent 54 to the crankcase (not shown). Piston 48 is analogous to piston 4 of the previously described embodiments to the extent that it serves to "absorb" (damper) peak pressure generated within combustion chamber 36.

This embodiment of FIGS. 6–8 utilizes a four stroke cycle and the conventional reciprocating piston engine drive mechanism 30, including a crankshaft 31, the output of which passes through a conventional transmission 40 to wheels 42, 42'. Power piston 32, reciprocating within cylinder 34, draws in air through intake valve 38 on its intake stroke and exhausts the gaseous products of combustion through exhaust valve 42 on its exhaust stroke. During the intake stroke, air is introduced to the system chamber (combustion chamber) 36 through open intake port and valve 38. With the intake valve 38 closed, the power piston 32 then compresses the charge. At or near TDC fuel is injected through fuel injector 44 and ignited by a spark plug 46 or by a glow plug or other ignition means including mere compression temperature. The increased pressure of the system begins moving free piston 48, as the combustion pressure exceeds a predetermined or preset value. That preset value is determined by (1) the ratios of area of power piston 32, the gas side of free piston 48 and the liquid side (upper side) of free piston 62, and (2) the discharge pressure of the liquid at 58. As combustion proceeds, the rising system pressure further accelerates free pistons 48 and 62, expanding the combustion gases (to suppress the rising system pressure and temperature) and compressing/pumping liquid contained in pump chamber 64 through exit high pressure liquid valve 58. As the system reaches the preset pressure value, positive acceleration of the free pistons 48 and 62 ceases, and the remaining system pressure and the kinetic energy of the moving free pistons 48 and 62 continue acting to pump liquid until the net force on the free pistons 48 and 62 has decelerated its velocity to zero. At this point, the high pressure liquid valve 58 shuts. Further expansion of the combustion gases occurs as the conventional expansion stroke proceeds. As the power piston 32 reaches BDC, an expansion ratio greater than compression ratio has also been achieved. In this sense also, floating piston 48 functions in a manner analogous to floating piston 5 in the embodiment of FIGS. 1 and 2. Exhaust valve 42 opens near BDC, and as the power piston 32 returns to TDC, spent combustion gases are exhausted. During the exhaust stroke, system chamber pressure is only slightly above atmospheric, and feed liquid under modest charge pressure enters through liquid inlet valve 60 re-charging pump chamber 64 and re-positioning the free piston 62/48 for the next power stroke. That portion of free piston 48 which does not overlap combustion chamber 36 (portion 52 of FIGS. 6 and 8) seems to decelerate free piston 48 to a "soft stop" as exhaust gases are "squeezed" into combustion chamber 36. The cycle then repeats.

The liquid pumped from chamber 64 can be used directly in a hydraulic motor (not shown) to efficiently produce shaft power, or the liquid may be stored in a conventional accumulator (not shown) by compressing a closed volume of gas. This stored pressure can be recovered at any later time and used directly in a hydraulic motor to produce an assist shaft power, for example, in the manner disclosed by Charles L. Gray, Jr., et al in their copending application Ser. No. 08/253,944 filed Jun. 3, 1994 and entitled "Hybrid Powertrain Vehicle," the teachings of which are incorporated herein by reference.

Figure 9:
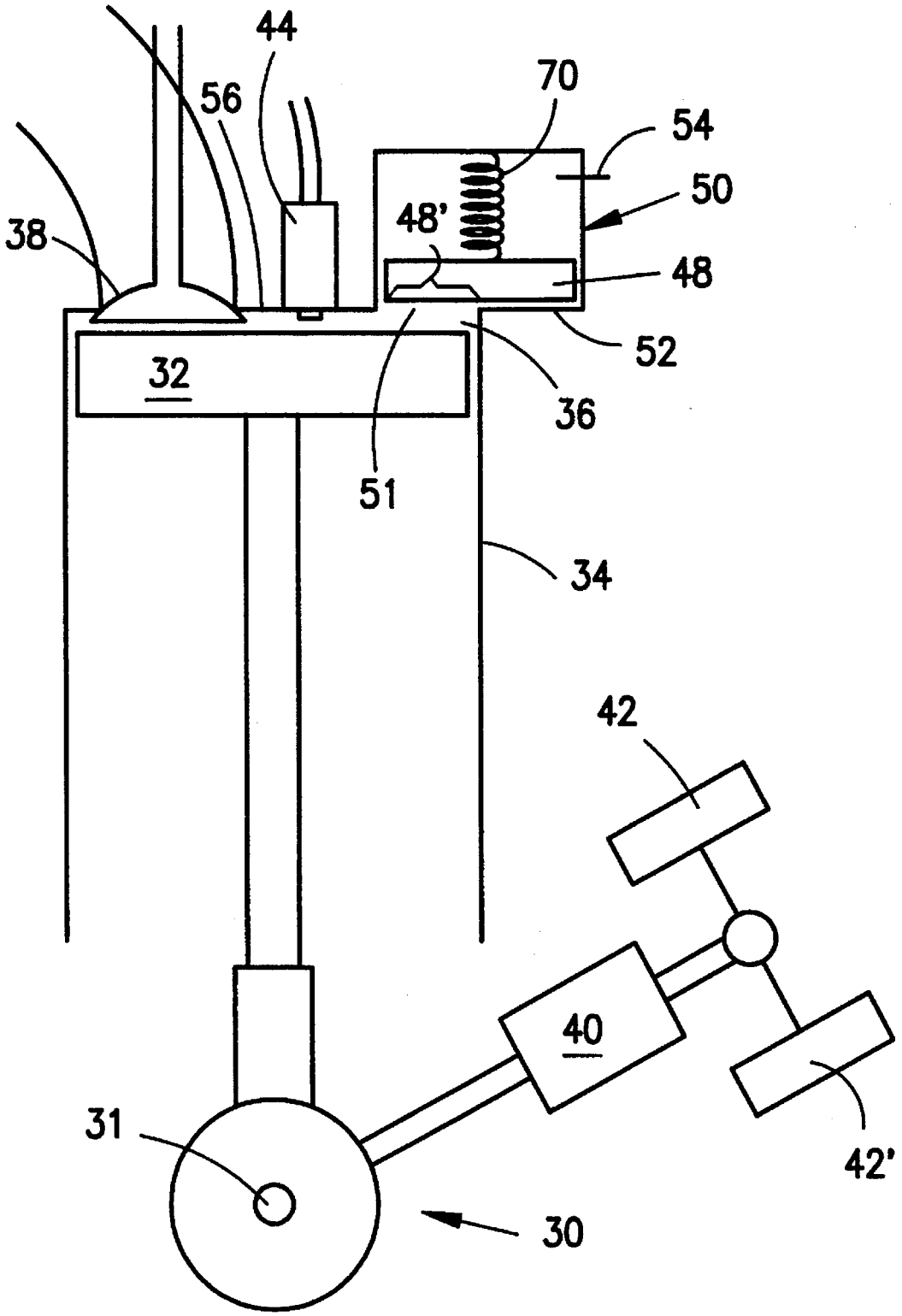
FIG. 9 is a schematic illustration of a fourth embodiment of the present invention in side view.

FIG. 9 shows an embodiment much like that of FIG. 6 but wherein the pump chamber 64, free piston 62 and associated hardware are replaced by a spring 70 mounted in auxiliary cylinder 50.

This invention can be applied to all closed-system compression/combustion/expansion cycle engines, including two as well as four stroke engines. In addition to or in place of direct fuel injection, fuel can be introduced with the air charge in all configurations. Sealing rings (not shown on figures) can be used for all pistons in all configurations.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A drive train for powering drive wheels of a vehicle, said drive train comprising:

a power cylinder and a power piston mounted in said power cylinder for reciprocating motion therein;

drive means for translating the reciprocating motion of said power piston into rotation of a crankshaft;

means for transmitting the rotation of said crankshaft to the drive wheels;

a combustion chamber defined within said power cylinder at one side of said power piston;

fuel feed means for feeding fuel into said combustion chamber;

an intake valve for admitting air into said combustion chamber during an intake stroke of said power piston to form a combustion mixture in combination with the fuel fed to said combustion chamber;

an exhaust valve for allowing, during an exhaust stroke of said power piston, expulsion from said combustion chamber of exhaust gases formed by combustion of the combustion mixture;

a floating piston at least partially closing said combustion chamber opposite said power piston, said floating piston being mounted for reciprocating motion relative to said combustion chamber; and intake and exhaust ports separately formed in said power cylinder in communication, respectively, with said intake and exhaust valves, said floating piston uncovering said input port during a first portion of the intake stroke and uncovering said exhaust port during said exhaust stroke, said floating piston moving in tandem with said power piston during a second portion of said intake stroke into a position closing said intake port; and wherein said reciprocating motion of said power piston includes a compression stroke in which the admitted air is compressed from a first volume $V_1$ to a second volume $V_2$, thereby defining a compression ratio $V_1/V_2$, and a power stroke produced by the combustion wherein the volume of gas within said combustion expands from $V_2$ to a volume $V_3$, thereby defining an expansion ratio $V_3/V_2$, said expansion ratio significantly exceeding said compression ratio.

2. A drive train in accordance with claim 1 wherein the expansion ratio is at least 1.2× the compression ratio.

3. A drive train in accordance with claim 1 wherein said floating piston is mounted for reciprocating motion in said power cylinder and completely closes said combustion chamber opposite said power piston.

4. A drive train in accordance with claim 1 additionally comprising:

spring means in contact with said floating piston for reciprocating motion therewith;

camming means for defining the extent of linear motion of said floating piston in a direction away from said power piston, said spring means bearing against said camming means, during said power stroke and compression stroke, in a position closing said intake and exhaust ports; and retaining means, for moving said floating piston in a direction away from said power piston by engagement of said camming means, to uncover said intake port during the first portion of the intake stroke and to uncover said exhaust port during said exhaust stroke and for releasing from said camming means during the second portion of said intake stroke, thereby allowing said floating piston to move in tandem with the motion of said power piston into the position closing said intake port.

5. A drive train in accordance with claim 4 wherein said power cylinder defines a central, longitudinal axis and wherein said intake and exhaust ports are bisected by a single plane perpendicular to said central, longitudinal axis.

6. An internal combustion engine in accordance with claim 1, wherein said intake and exhaust valve are one-way valves.

7. An internal combustion engine drive train in accordance with claim 4 wherein said retaining means releases said floating piston at a predetermined set-point position during said intake stroke, allowing said floating piston to freely travel downward to close off the air intake port, and wherein downward movement of said floating piston is stopped and reversed by air compressed during the compression stroke.

8. An internal combustion engine drive train in accordance with claim 1 wherein said reciprocating motion of said floating piston includes a pressure relieving stroke in which said floating piston moves away from said combustion chamber, responsive to a predetermined pressure being produced within said combustion chamber by the combustion of the combustion mixture, to reduce peak combustion pressure.

9. A drive train in accordance with claim 1 further comprising spring means for storing a portion of the energy of combustion by action of said floating piston compressing said spring means responsive to combustion within said combustion chamber.

10. A drive train for powering drive wheels of a vehicle, said drive train comprising:

a power cylinder and a power piston mounted in said power cylinder for reciprocating motion therein;

drive means for translating the reciprocating motion of said power piston into rotation of a crankshaft;

means for transmitting the rotation of said crankshaft to the drive wheels;

a combustion chamber defined within said power cylinder at one side of said power piston;

fuel feed means for feeding fuel into said combustion chamber;

an intake valve for admitting air into said combustion chamber during an intake stroke of said power piston to form a combustion mixture in combination with the fuel fed to said combustion chamber;

an exhaust valve for allowing, during an exhaust stroke of said power piston, expulsion from said combustion chamber of exhaust gases formed by combustion of the combustion mixture;

a floating piston at least partially closing said combustion chamber opposite said power piston, said floating piston being mounted for reciprocating motion relative to said combustion chamber;

intake and exhaust ports formed in said power cylinder in communication, respectively, with said intake and exhaust valves;

spring means in contact with said floating piston for reciprocating motion therewith;

camming means for defining the extent of linear motion of said floating piston in a direction away from said power piston, said spring means bearing against said camming means, during said power stroke and compression stroke, in a position closing said intake and exhaust ports; and retaining means, engaging said camming means, for moving said spring means and said floating piston in a direction away from said power piston, to uncover said intake port during a first portion of the intake stroke and to uncover said exhaust port during said exhaust stroke.

11. A drive train for powering drive wheels of a vehicle, said drive train comprising:

a power cylinder and a power piston mounted in said power cylinder for reciprocating motion therein;

drive means for translating the reciprocating motion of said power piston into rotation of a crankshaft;

means for transmitting the rotation of said crankshaft to the drive wheels;

a combustion chamber defined within said power cylinder at one side of said power piston;

fuel feed means for feeding fuel into said combustion chamber;

an intake valve for admitting air into said combustion chamber during an intake stroke of said power piston to form a combustion mixture in combination with the fuel fed to said combustion chamber;

an exhaust valve for allowing, during an exhaust stroke of said power piston, expulsion from said combustion chamber of exhaust gases formed by combustion of the combustion mixture;

a floating piston at least partially closing said combustion chamber opposite said power piston, said floating piston being mounted for reciprocating motion relative to said combustion chamber; and an auxiliary cylinder defining a gas space and containing said floating piston for reciprocating motion therein, said gas space having a diameter smaller than that of said combustion chamber and being divided into first and second auxiliary, gas-containing chambers, said first auxiliary chamber containing spring means mounted therein for biasing said floating piston toward said combustion chamber and said second auxiliary chamber being in fluid communication with said combustion chamber.

12. A drive train in accordance with claim 11 additionally comprising:

a pumping cylinder and a pumping piston reciprocally mounted in said pumping cylinder and defining a pump chamber in cooperation with said pumping cylinder, said pumping piston being rigidly fixed to said floating piston for reciprocating movement therewith said pump chamber having a liquid inlet and a liquid outlet and having a diameter smaller than the diameter of said combustion chamber.

* * * * *